United States Patent [19]

Iwakawa et al.

[11] 3,953,762

[45] Apr. 27, 1976

[54] CIRCUIT FOR SUPPLYING A SPECIFIED ONE OF PLURAL EXTERNAL ELECTRODES OF A GAS DISCHARGE DISPLAY PANEL WITH UNIDIRECTIONAL FIRING VOLTAGE PULSES AND FOR SUPPLYING OTHERS WITH PULSES OF A REDUCED VOLTAGE

[75] Inventors: Tsunekiyo Iwakawa; Akira Yano, both of Tokyo, Japan

[73] Assignee: Nippon Electric Co., Ltd., Tokyo, Japan

[22] Filed: Sept. 25, 1974

[21] Appl. No.: 509,047

[30] Foreign Application Priority Data

Oct. 3, 1973 Japan ..... 48-111307

[52] U.S. Cl. ..... 315/169 TV; 315/84.5

[51] Int. Cl.[2] ..... H05B 37/00

[58] Field of Search ..... 315/169 TV, 84.5

[56] References Cited

UNITED STATES PATENTS

| | | | |
|---|---|---|---|
| 3,742,294 | 6/1973 | Wojcik | 315/169 TV |
| 3,771,016 | 11/1973 | Toba et al. | 315/169 TV |
| 3,801,863 | 4/1974 | Lee | 315/169 TV |

*Primary Examiner*—R. V. Rolinec
*Assistant Examiner*—Lawrence J. Dahl
*Attorney, Agent, or Firm*—Hopgood, Calimafde, Kalil, Blaustein & Lieberman

[57] ABSTRACT

In a driving circuit for a gas discharge display panel having first and second electrodes externally disposed on opposite sides of gas discharge cells, use has been made of an arrangement for supplying pulses of a unidirectional firing voltage of the panel to specified of the first electrodes. The present arrangement comprises means for producing the unidirectional pulses and means for supplying unidirectional pulses, with a reduced pulse height, to others of the first electrodes.

12 Claims, 2 Drawing Figures

CIRCUIT FOR SUPPLYING A SPECIFIED ONE OF PLURAL EXTERNAL ELECTRODES OF A GAS DISCHARGE DISPLAY PANEL WITH UNIDIRECTIONAL FIRING VOLTAGE PULSES AND FOR SUPPLYING OTHERS WITH PULSES OF A REDUCED VOLTAGE

BACKGROUND OF THE INVENTION

This invention relates to electronic display driving apparatus and, more specifically to a circuit arrangement for driving an external electrode gas discharge display panel (usually called a plasma display panel) in a time division fashion.

A plasma display panel generally comprises a stack of three thin flat glass or transparent dielectric plates. The central plate is provided with a plurality of perforations at predetermined locations. The periphery of the stack is hermetically sealed. The internal voids within the stack are evacuated and then filled with neon or a similar inert gas or mixture of gases. On one surface of each of the outer plates, there is disposed the so-called matrix electrodes which consist of rows and columns of electrodes perpendicularly spacially intersecting one another with the perforations, i.e., the gas-filled voids, interposed therebetween. The matrix electrodes crossing at each of the selected perforations which correspond to a letter or symbol to be displayed are selectively supplied with high-frequency pulses whereby a gas discharge is caused in the selected perforations to display the desired letter or symbol. In one improvement for such conventional plasma display panels constructed as above described, two thick glass or transparent dielectric plates are used as the outer plates and provided with thin glass or other dielectric films on their inside surfaces, respectively. Further, a plasma display panel having no central plate, and a plasma display panel in which segmented type electrodes are substituted for the matrix electrodes, have been proposed.

In any of the conventional panels, discharge occurs in a gas space (herein called a gas discharge cell) identified by a pair of opposing external electrodes which are selectively supplied with a direct current voltage higher than the firing voltage $V_f$ of the cell (with the voltage drop across the dielectric plates being neglected). Once discharge occurs in a cell, charged particles generated by the discharge charge the dielectric plates to reduce the strength of the electric field within the cell until the discharge ceases when the sum of the supplied voltage and the reverse voltage resulting from the charges stored on the dielectric plates falls below the discharge sustaining voltage $V_s$ of the cell. The time interval between occurrence of the discharge and termination thereof is from scores to several hundreds of nanoseconds. When the polarity of the direct current voltage supplied between the opposing external elecrtrodes is reversed to be of the same polarity as the voltage resulting from the stored charge, the voltages applied across the cell are superimposed on each other to become sufficiently higher than the firing voltage $V_f$. Thereupon, the discharge starts again until it eventually ceases. By repeating the procedure, namely, by applying a voltage of alternating or successively reversed polarity between the opposing external electrodes, it is possible to sustain the intermittent discharge. If the frequency of repetition of the intermittent discharge per unit time is appropriately selected (for example, 5 kHz), it is possible to provide a display of sufficient brightness.

A preferred conventional circuit arrangement for driving a plasma display panel comprises means responsive to a d.c. voltage at least equal to the unidirectional firing voltage $V_{uf}$ of the panel, high-frequency or clock pulses, and each of first address pulses specifying respective ones of the first electrodes of the panel, which may be the row electrodes, or supplying unidirectional pulses of a pulse height at least equal to the unidirectional firing voltage $V_{uf}$ and of the pulse repetition frequency of the clock pulses to the first electrode specified by the above-mentioned first address pulses. The circuit arrangement further comprises means comprising, in turn, variable impedance elements adapted for connection to respective ones of the second electrodes of the panel, which may be the column electrodes, and rendered on in accordance with respective ones of second address pulses specifying the respective second electrodes to prevent pulses from being derived at the second electrode specified by each of the second address pulses through the electrostatic coupling which is present between the first and second electrodes within the panel.

As will later be described in detail with reference to the accompanying drawing, it is necessary to use switching elements capable of withstanding a high voltage and a plurality of AND gates in the unidirectional pulse supplying means of the preferred conventional circuit arrangement. This has rendered the prior art conventional circuit arrangement expensive and complicated.

SUMMARY OF THE INVENTION

It is therefore an object of this invention to provide a circuit arrangement for driving a plasma display panel, wherein use may be made of switching elements of a relatively low voltage withstanding capability, whereby it is made possible to reduce the price of plasma display panel driving circuits and to facilitate manufacture thereof by the integrated circuit techniques.

It is another object of this invention to provide a circuit arrangement of the type described, wherein AND gates are rendered unnecessary to make it possible to simplify the circuit arrangement and to further reduce the price of the circuit arrangements.

As described above, a preferred conventional circuit arrangement is adapted for connection to an external electrode gas discharge display panel comprising a plurality of gas discharge cells and first and second electrodes disposed externally on opposite sides of the discharge cells. By the nature of the display-electrode construction, the first and second electrodes are electrostatically coupled to one another through the interposed discharge cells. Also, the discharge panel has a certain unidirectional firing voltage $V_{uf}$.

On driving the discharge panel actually connected to the circuit arrangement, use is made of a d.c. power source of a d.c. voltage at least equal to the unidirectinal firing voltage $V_{uf}$, a clock pulse generator for producing clock pulses of a clock frequency, and means for producing first address pulses specifying the respective ones of the first electrodes and second address pulses specifying the respective second electrodes in timed relation to the first address pulses. The circuit arrangemet comprises means responsive to the d.c. voltage, the clock pulses, and each of the first address pulses for supplying unidirectional pulses of a pulse height at least equal to the d.c. voltage and of a pulse repetition frequency equal to the clock frequency to the first electrode specified by the above-mentioned each first address pulse. The circuit arrangement further comprises means comprising, in turn, variable impedance elements adapted for connection to the second electrodes and rendered on in accordance with the respective ones of the second address pulses to prevent pulses from being derived through the electrostatic coupling at the second electrode specified by each of the second address pulses.

In accordance with this invention, there is provided an improvement in a circuit arrangement of the type described in the next preceding paragraph, wherein use is made of the unidirectional discharge sustaining voltage $V_{us}$ inherent in the discharge panel. Use is also made of an auxiliary d.c. power source which supplies a voltage not higher than the first-mentioned d.c. voltage, and lower than the difference between the first-mentioned d.c. voltage and the discharge sustaining voltage $V_{us}$. In accordance with the improved circuit arrangement, the above-mentioned unidirectional pulse supplying means comprises first means responsive to the first-mentioned d.c. voltage and the clock pulses for producing the unidirectional pulses and second means responsive to the first address pulses for supplying the unidirectional pulses, with the pulse height reduced substantially to the difference, to those of the first electrodes which are not specified by the above-mentioned each first address pulse.

As will readily be understood, the first electrodes may either be the row electrodes or the column electrodes. Alternatively, the first electrodes may be those segment electrodes which are disposed on one side of the gas discharge cells. Each of the variable impedance elements may be a transistor.

DESCRIPTION OF THE PREFERRED EMBODIMENTS

Figure 1:
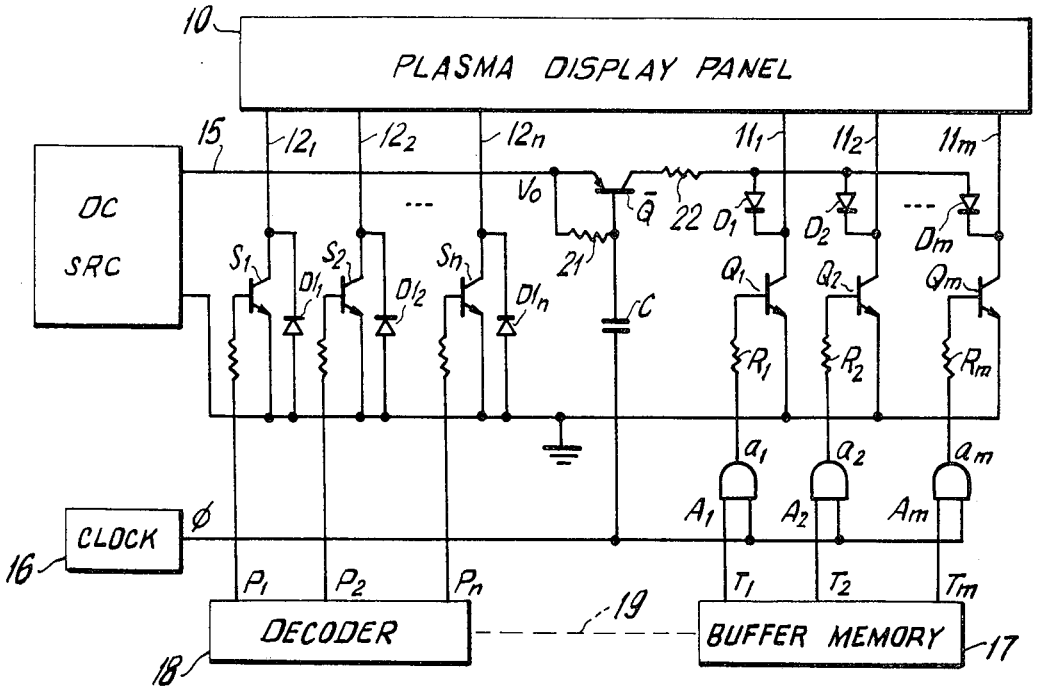
(PRIOR ART) FIG. 1
FIG. 1 schematically shows a plasma display panel and a conventional driving circuit therefor of a preferred type, together with power and signal sources or the driving circuit.

Referring to FIG. 1, a preferred conventional circuit arrangement for driving an external electrode gas discharge display panel 10 will be described first to facilitate understanding of the present invention. The display panel 10 comprises a plurality of gas discharge cells (not shown), first electrodes $\mathbf{11}_1$, $\mathbf{11}_2$. . . , and $\mathbf{11}_m$, disposed on one side of the discharge cells, and second electrodes $\mathbf{12}_1$, $\mathbf{12}_2$, . . . , and $\mathbf{12}_n$, disposed on the other side of the discharge cells. For driving the display panel 10, use is made of a d.c. power source 15 for producing a d.c. voltage $V_O$ which is at least equal to a unidirectional firing voltage $V_{uf}$ characterizing to the display panel 10; a clock pulse generator 16 or generating high-frequency or clock pulses $\phi$ varying between a high and a low level at a clock frequency; an m-stage buffer memory 17 for cyclically producing first address pulses $T_1$, $T_2$, . . . , and $T_m$ of a high level for specifying the respective first electrodes 11; an an n-digit decoder 18 coupled to the buffer memory 17 trhough a timing connection 19 for selectively producing one of second address pulses $P_1$, $P_2$, . . . , and $P_n$ of a high level specifying the respective second electrodes 12 in coincidence with selected one of the first address pulses T.

The circuit arrangement comprises first NPN switching transistors $Q_1$, $Q_2$, . . . , and $Q_m$ having collector electrodes directly connected to the respective first electrodes 11, and grounded emitter electrodes. AND gates $A_1$, $A_2$, . . . , and $A_m$ having output terminals $a_1$, $a_2$, . . . , and $a_m$ are connected to the base electrodes of the first switching transistors Q through resistors $R_1$, $R_2$, . . . , and $R_m$, and a single PNP transistor $\overline{Q}$ has its emitter electrode directly connected to the d.c. power source 15, its base electrode connected to the d.c. power source 15 through a resistor 21 and to the clock pulse generator 16 through a capacitor C, and its collector electrode connected through a protection resistor 22 and forwardly directed diodes $D_1$, $D_2$, . . . , and $D_m$ to the collector electrodes of the respective first switching transistors Q. The AND gates A are arranged to be enabled by the clock pulses $\phi$ and the respective first address pulses T.

The circuit arrangement further comprises second switching transistors $S_1$, $S_2$, . . . , and $S_n$, also of the NPN type, having their collector electrodes directly connected to the respective second electrodes 12 and to ground through protection diodes $\mathbf{D1}_1$, $\mathbf{D1}_2$, . . . , and $\mathbf{D1}_n$. The emitter electrodes of the transistors S are directly grounded, and the base electrodes thereof are connected to the decoder 18 through resistors.

In operation, the single transistor $\overline{Q}$ is rendered off and on when the clock pulses $\phi$ assume the high and low levels, respectively. When a first one $T_1$ of the first address pulses appears (assumes the high level), a corresponding one $A_1$ of the AND gates renders the associated first switching transistor $Q_1$ on and off (conductive and non-conductive) each time the clock pulses $\phi$ assume the high and low levels, respectively. When this first switching transistor $Q_1$ is conductive, the single transistor $\overline{Q}$ is nonconductive. The first one $\mathbf{11}_1$ of the first electrodes is therefore supplied with zero potential. When the first switching transistor $Q_1$ becomes nondconductive, the single transistor $\overline{Q}$ is rendered on to supply the d.c. voltage $V_O$ to the selected first electrode $\mathbf{11}_1$ through the associated diode $D_1$. It follows therefore that the complementary operation of the single transistor $\overline{Q}$ and that one of the first switching transistors Q for which one of the first address pulses T is produced, results in application to the selected one of the first electrodes 11 of a short train of unidirectional pulses which vary between zero potential and the d.c. voltage $V_O$ at the clock frequency.

When the first one $A_1$ of the AND gates is supplied with no first address pulses (is supplied with a low level at one of two input terminals thereof), the associated first switching transistor $Q_1$ is kept nonconductive. The revelant first electrode $\mathbf{11}_1$ is therefore supplied at such times with the d.c. voltage $V_O$ irrespective of the single transistor $\overline{Q}$ switching on and off.

The protection resistor 22 is for preventing the single transistor $\overline{Q}$ and each of the first switching transistors Q from becoming simultaneously conductive due to storage time delays. On the other hand, the first one $S_1$ of the second switching transistors is rendered conductive upon production of relevant an associated one $P_1$ of the second address pulses. This decreases the emitter-collector resistance of this second switching transistor $S_1$ thereby clamping, the associated second electrode $\mathbf{12}_1$ to zero potential.

As pointed out briefly in the preamble of the instant specification, electrostatic coupling inherently exists within the display panel 10 between the first and second electrodes 11 and 12. Accordingly, upon application of the unidirectional pulses to a particular one of the first electrodes 11, pulses are produced at those of the second electrodes 12 which are not clamped to zero potential. The pulses so produced counteract the unidirectional pulses to suppress a gas discharge between the particular first electrode and the last-mentioned second electrodes. The capacitively coupled pulses do not appear at the specific second electrode clamped to zero potential, and thus the unidirectional pulses produce a gas discharge in a gas discharge cell interposed between the particular first electrode and the specific second electrode. The protection diodes D1 protect those of the second transistors S which are nonconductive, to whose collector electrodes the derived high-frequency pulses would otherwise supply a negative voltage.

In connection with the circuit arrangement illustrated with reference to FIG. 1, it should be pointed out that use is made of the AND gates A. In addition, it is necessary that the first switching transistors Q must be capable of withstanding the d.c. voltage $V_O$. As for the second switching transistors S, the derived high-frequency pulses supply the d.c. voltage $V_O$ divided in the ratio of the stray capacitance of their collector electrodes to the capacity of the electrostatic coupling. Since the former capacitance is approximately equal to the latter capacitance, the second switching transistors S must withstand about a half ($V_O/2$) of the d.c. voltage.

Figure 2:
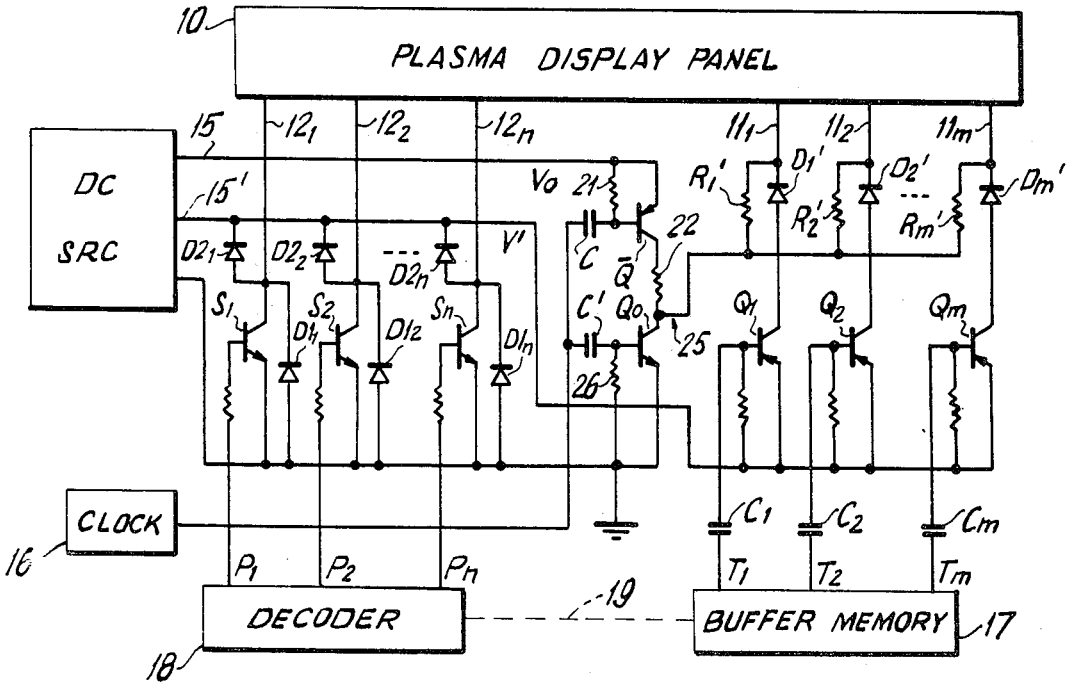
FIG. 2 similarly shows a plasma display panel, a driving circuit therefor in accordance with to a preferred embodiment of this invention, and power and signal sources for the driving circuit.

Referring now to FIG. 2, there is shown a circuit arrangement according to a preferred embodiment of this invention for driving an external electrode gas discharge display panel 10 of the type described with reference to FIG. 1. The circuit arrangement makes use of a main d.c. power source 15, a clock pulse generator 16, an m-stage buffer memory 17, and an n-digit decoder 18, all of the type similarly described with respect to the FIG. 1 circuitry. An auxiliary d.c. power source 15' is also employed to produce an auxiliary d.c. voltage V' which is not higher than the main d.c. voltage $V_O$, and is not lower than the difference between the main d.c. voltage $V_O$ and a unidirectional discharge sustaining voltage $V_{us}$ which is inherent to the display panel 10. The auxiliary d.c. power source 15' may be a portion of the main d.c. power source 15.

The circuit arrangement comprises a unidirectional pulse producing circuit 25 comprrising, in turn, a single PNP transistor $\overline{Q}$ whose emitter electrode is directly connected to the main d.c. power source 15, and having its base electrode connected to the d.c. power source 15 through a resistor 21 and to the clock pulse generator 16 through a capacitor C. The circuit 25 further includes an NPN transistor $Q_O$ having its collector electrode connected to the single PNP transistor collector electrode through a protection resistor 22, its emitter electrode directly grounded, and its base electrode grounded through a resistor 26 and connected to the clock pulse generator 16 through a capacitor C'. If isolated from the remaining portion of the circuit arrangement, the unidirectional pulse producing circuit 25 produces at the collector electrode of the NPN transistor $Q_O$ unidirectional pulses which vary substantially between zero potential and the main d.c. voltage $V_O$ at the clock frequency in a manner similar to that described with reference to FIG. 1.

Further referring to FIG. 2, the circuit arrangement comprises first switching transistors $Q_1, Q_2, \ldots,$ and $Q_m$ of the PNP type having collector electrodes connected to the collector electrode of the NPN trnsistor $Q_O$ through diodes $D_1', D_2', \ldots,$ and $D_m'$ and resistors $R_1$40, $R_2', \ldots,$ and $R_m'$. The emitter electrodes of the transistors $Q_1, \ldots Q_m$ are directly connected to the auxiliary d.c. power source 15', and the base electrodes thereof are connected to the auxiliary d.c. power source 15' through resistors and to the buffer memory 17 through capacitors $C_1, C_2, \ldots,$ and $C_m$. The connection points between the diodes D' and the resistors R' directly connected to the respective first electrodes 11.

The FIG. 2 circuit arrangement further comprises second switching transistors $S_1, S_2, \ldots,$ an $S_n$ of the NPN type having collector electrodes grounded through first diodes $D1_1, D1_2, \ldots,$ and $D1_n$ and adapted for connection to the auxiliary d.c. power source 15' through second diodes $D2_1, D2_2, \ldots,$ and $D2_n$. The emitter electrodes of the second switching transistors S are directly grounded, and the base electrodes thereof are connected to the decoder 18 through resistors. It will be understood that the first and second diodes D1 and D2 are reversely directed between ground and the auxiliary d.c. power source 15'.

In operation, assume that the first one $T_1$ of the first address pulses is not present (is of a low level). The corresponding one $Q_1$ of the first switching transistors is thus conductive. Each time the single PNP transistor $\overline{Q}$ and the associated NPN transistor $Q_O$ are rendered on and off, respectively, an electric curent flows from the auxiliary d.c. power source 15' to ground through the now conducting first switching transistor $Q_1$ and the associated diode $D_1'$ and resistor $R_1'$. The pulses applied to the associated one of the first electrodes 11 therefore vary between the main d.c. voltage $V_O$ and the auxiliary d.c. voltage V'. When the first one $T_1$ of the first address pulses appears, the corresponding first switching transistor $Q_1$ is rendered non conductive. The selected first electrode $11_1$ is now supplied with the unidirectional pulses.

If the first one $P_1$ of the second address pulses is present, the corresponding one $S_1$ of the second switching transistors is turned on. When conductive, each of the second switching transistors S clamps the selected one of the second electrodes 12 to zero potential as in the conventional circuit arrangement. Under these circumstances, either the full unidirectional pulses or the pulses of reduced pulse height supplied to any particular one of the first electrodes 11 are applied across the gas discharge cell interposed between the particular first electrode and the selected second electrode.

When not supplied with a second address pulses P, each of the second switching transistors S is nonconductive. Therefore, pulses are derived through the electrostatic coupling at those of the second electrodes 12 which are not clamped to zero potential. Electric currents, however, flow through the associated ones of the second diodes D2 each time the coupled pulses so derived tend to raise the potential of the revelant second electrodes above the auxiliary d.c. voltage V'. Consequently, pulses whose heights are reduced by the auxiliary d.c. voltage V' are applied across the gas discharge cells arranged along the second electrodes which are not clamped to zero potential.

It is observed that the first diodes D1 prevent the potential of the second electrodes 12 from going negative due to the derived (capacitively coupled) pulses which assume a negative voltage. Similarly, the diodes D′ protect the first switching transistors $Q_1$ through $Q_m$ against the unidirectional pulses.

Summarizing, the following Table shows, for the first and second address pulses T and P, the on-off states of the first and second switching transistors Q and S, the amplitude of pulses supplied Table

| P | S | 12 | T<br>Q<br>11 | high level<br>off<br>$V_o$ | low level<br>on<br>$V_o - V'$ |
|---|---|---|---|---|---|
| high level | on | O | | $V_o$ | $V_o - V'$ |
| low level | off | V′ | | $V_o - V'$ | $V_o - 2V'$ |

to the first and second electrodes 11 and 12; and the amplitude of pulses applied across the gas discharge cell interposed between a relevant one of each of the first and second electrodes 11 and 12. Only when the pulse height is equal to $V_o$ or higher does a gas discharge occur in the gas discharge cell.

In the circuit arrangement according to the prefered embodiment, it will be seen that the AND gates A used in the conventional circuit arrangement are unnecessary and that the voltages withstanding capacity of the switching transistors $Q_1$ through $Q_m$ and S need only be that of the auxiliary d.c. voltage V′ (although the diodes D′ associated with the first switching transistors Q should withstand the main d.c. voltage $V_o$). It is noted that the auxiliary d.c. voltage V′ may be equal to the difference between the unidirectional firing voltage $V_{uf}$ and the unidirectional discharge sustaining voltage $V_{us}$ of the display panel 10, which difference is dependent on the uniformity of the gas discharge cells of the panel 10 and is about 30 volts in a present-day display panel. The switching transistors Q and S may therefore comprise MOS switching elements and may readily be realized by the integrated circuit techniques.

What is claimed is:

1. In a circuit arrangement adapted for connection to an external electrode gas discharge display panel comprising a plurality of gas discharge cells and first and second electrodes disposed externally on opposite sides of said discharge cells and electrostatically coupled with said discharge cells interposed, said discharge panel having a unidirectional firing voltage, said circuit arrangement being adapted for connection also to a d.c. power source of a d.c. voltage at least equal to said unidirectional firing voltage, a clock pulse generator for producing clock pulses of a clock frequency, and means for producing first address pulses specifying the respective ones of said first electrodes and second address pulses specifying the respective ones of said second electrodes in timed relation to said first address pulses, said circuit arrangement including:

means responsive to said d.c. voltage, said clock pulses, and each of said first address pulses for supplying unidirectional pulses of a pulse height at least equal to said d.c. voltage and of a pulse repetition frequency equal to said clock frequency to the first electrode specified by said each first address pulse and means comprising variable impedance elements adapted for connection to said second electrodes and rendered on in accordance with the respective ones of said second address pulses to prevent pulses from being derived through electrostatic coupling at the second electrode specified by each of said second address pulses, said discharge panel having a unidirectional discharge sustaining voltage, said circuit arrangement being adapted for further connection to an auxiliary d.c. power source of an auxiliary d.c. voltage which is not higher than the first-mentioned d.c. voltage and is not lower than the difference between the first-mentioned d.c. voltage and said discharge sustaining voltage, the improvement wherein said unidirectional pulse supplying means comprises:

first means responsive to the first-mentioned d.c. voltage and said clock pulses for producing said unidirectional pulses and second means responsive to said first address pulses for supplying said undirectional pulses with the pulse height reduced substantially to said difference to those of said first electrodes which are not specified by said each first address pulses.

2. In a circuit arrangement adapted for connection to an external electrode gas discharge display panel comprising a plurality of gas discharge cells and first and second electrodes disposed externally on opposite sides of said discharge cells and electrostatically coupled with said discharge cells interposed, said discharge panel having a unidirectional firing voltage, said circuit arrangement being adapted for connection also to a d.c. power source of a d.c. voltage at least equal to said unidirectional firing voltage, a clock pulse generator for producing clock pulses of a clock frequency, and means or producing first address pulses specifying the respective ones of said first electrodes and second address pulses specifying the respective ones of said second electrodes in timed relation to said first address pulses, said circuit arrangement including means responsive to said d.c. voltage, said clock pulses, and each of said first address pulses for supplying unidirectional pulses of a pulse height at least equal to said d.c. voltage and of a pulse repetition frequency equal to said clock frequency to the first electrode specified by said each first address pulse, means comprising variable impedance elements adapted for connection to said second electrodes and rendered on in accordance with the respective ones of said second address pulses to prevent pulses from being derived through electrostatic coupling at the second electrode specified by each of said second address pulses, said discharge panel having a unidirectional discharge sustaining voltage, said circuit arrangement being adapted for further connection to an auxiliary d.c. power source of an auxiliary d.c. voltage which is not higher than the first-mentioned d.c. voltage and is not lower than the difference between the first-mentioned d.c. voltage and said discharge sustaining voltage, the improvement wherein said unidirectional pulse supplying means comprises first means responsive to the first-mentioned d.c. voltage and said clock pulses for producing said unidirectional pulses, and second means responsive to said first address pulses for supplying said unidirectional pulses with the pulse height reduced substantially to said difference to those of said first electrodes which are not specified by said each first address pulses, wherein said first means comprises first and second capacitors, a single PNP transistor having its emitter electrode connected to the first-mentioned d.c. power source and its base electrode connected to said clock pulse generator by said first capacitor, a single NPN transistor having its emitter electrode grounded and its base electrode connected to said clock pulse generator through said second capacitor, and a resistor interposed between collector electrodes of said single PNP and NPN transistors.

3. A circuit arrangement as claimed in claim 2, said first and second address pulse producing means comprising means for cyclically producing said first address pulses, wherein said second means comprises a plurality of resistors, each having an end connected to the collector electrode of said single NPN transistor, a like number of diodes having cathodes connected to the other ends of said plurality of resistors and adapted for connection to said first electrodes, plural additional capacitors, and a like number of PNP switching transistors having collector electrodes connected to anodes of said diodes, emitter electrodes connected to said auxiliary d.c. power source, and base electrodes connected to said first address pulse producing means through said plural additional capacitors.

4. A circuit arrangement as claimed in claim 1, said first and second address pulse producing means comprising means for selectively producing each of said second address pulses in timed relation to a selected one of said first address pulses, wherein said variable impedance elements are NPN switching transistors having collector electrodes connected to said second electrodes, grounded emitter electrodes, and base electrodes connected to said second address pulse producing means, the collector electrodes of said NPN switching transistors being connected to respective anodes of a plurality of diodes whose cathodes are adapted for connection to said auxiliary d.c. power source.

5. A circuit arrangement as claimed in claim 4, further comprising plural diodes, and wherein the collector electrodes of said NPN switching transistors are connected to the cathodes of said diodes, the anodes of said diodes being grounded.

6. In combination in driving circuit apparatus for plasma display including first and second selection electrode pluralities, first and second potential source means, the potential of said first source exceeding that of said second source, plural first switching transistors having their collector-emitter conduction paths connected in parallel between said first and second potential sources and adapted for connection to different ones of the first display electrodes, a first transistor for connecting said first potential source to the first electrodes and to said first plural switching transistors, a second transistor for grounding the first electrodes, and plural second switching transistors for selectively grounding a different one of the second electrodes.

7. A combination as in claim 6 further comprising a clock source for alternately enabling said first and second transistors.

8. A combination as in claim 7 further comprising means for activating selected of said first and second plural switching transistors.

9. A combination as in claim 8 wherein said first transistor and said first switching transistor plurality comprise PNP transistors, and wherein said second transistor and said second switching transistor plurality comprise NPN transistors.

10. A combination as in claim 6 further comprising plural resistors each connected between the collector of a different one of said first plural switching transistors and said second transistor.

11. A circuit arrangement as claimed in claim 1, wherein said first means comprises a single PNP transistor whose emitter electrode is adapted for connection to the first-mentioned d.c. power source and whose base electrode is adapted for connection to said clock pulse generator through a capacitor, a single NPN transistor whose emitter electrode is grounded and whose base electrode is adapted for connection to said clock pulse generator through a capacitor, and a resistor interposed between collector electrodes of said single PNP and NPN transistors.

12. A circuit arrangement as claimed in claim 11, said first and second address pulse producing means comprising means for cyclically producing said first address pulses, wherein said second means comprises a plurality of resistors, each having an end connected to the collector electrode of said single NPN transistor, a like number of diodes having cathodes connected to the other ends of said plurality of resistors and adapted for connection to said first electrodes, and a like number of PNP switching transistors whose collector electrodes are connected to anodes of said diodes, whose emitter electrodes are adapted for connection to said auxiliary d.c. power source, and whose base electrodes are adapted for connection to said first address pulse producing means.

* * * * *

UNITED STATES PATENT OFFICE

CERTIFICATE OF CORRECTION

Patent No. 3953762 Dated April 27, 1976

Inventor(s) Tsunekiyo Iwakawa et al

It is certified that error appears in the above-identified patent and that said Letters Patent are hereby corrected as shown below:

Page 1 - Assignee incorrectly printed. Should read NIPPON ELECTRIC COMPANY, LIMITED rather than NIPPON ELECTRIC CO., LTD.

Claim 2, Column 8, Line 34 - after "means" delete "or" and insert --for--.

Signed and Sealed this

Twentieth Day of July 1976

[SEAL]

*Attest:*

RUTH C. MASON
*Attesting Officer*

C. MARSHALL DANN
*Commissioner of Patents and Trademarks*